US009027642B2

(12) United States Patent
Sladic et al.

(10) Patent No.: US 9,027,642 B2
(45) Date of Patent: May 12, 2015

(54) DUAL-PURPOSE STEAM INJECTION AND PRODUCTION TOOL

(75) Inventors: John S. Sladic, Katy, TX (US); Brian Sternaman, Lafayette, LA (US); Christopher Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 379 days.

(21) Appl. No.: 13/115,677

(22) Filed: May 25, 2011

(65) Prior Publication Data

US 2012/0298356 A1 Nov. 29, 2012

(51) Int. Cl.

| | |
|---|---|
| ***E21B 43/00*** | (2006.01) |
| ***E21B 43/24*** | (2006.01) |
| ***E21B 41/00*** | (2006.01) |

(52) U.S. Cl.

CPC ..... *E21B 43/24* (2013.01); *E21B 41/0078* (2013.01)

(58) Field of Classification Search

CPC ..... E21B 43/16; E21B 43/24; E21B 43/2408; E21B 43/2406; E21B 43/25; C09K 8/58; C09K 8/592

See application file for complete search history.

(56) References Cited

U.S. PATENT DOCUMENTS

| | | | | |
|---|---|---|---|---|
| 3,379,249 | A | 4/1968 | Gilchrist et al. | |
| 4,399,865 | A | 8/1983 | Anderson et al. | |
| 4,770,244 | A | 9/1988 | Webb | |
| RE33,614 | E * | 6/1991 | Schwab et al. | 166/303 |
| 6,158,510 | A | 12/2000 | Bacon et al. | |
| 6,708,763 | B2 | 3/2004 | Howard et al. | |
| 7,631,694 | B2 | 12/2009 | Struyk et al. | |
| 2006/0048942 | A1 * | 3/2006 | Moen et al. | 166/306 |
| 2008/0169099 | A1 * | 7/2008 | Pensgaard | 166/285 |
| 2010/0108313 | A1 * | 5/2010 | Chan et al. | 166/263 |
| 2012/0145399 | A1 * | 6/2012 | Schultz et al. | 166/303 |

OTHER PUBLICATIONS

First Office Action received in corresponding Canadian application 2,776,072, dated Apr. 8, 2013.

Weatherford, "The SteamSaver Injection System," Brochure 724.02, copyright 2004-2009.

* cited by examiner

*Primary Examiner* — Jennifer H Gay
*Assistant Examiner* — Caroline Butcher
(74) *Attorney, Agent, or Firm* — Wong, Cabello, Lutsch, Rutherford & Brucculeri, LLP

(57) ABSTRACT

A dual-purpose tool can be used for steam injection and production in a wellbore. A mandrel deploys in the wellbore to communicate steam in a steam injection operation and to communicate production fluid from the wellbore during production operations. A distributor on the mandrel has nozzles for injecting steam into the wellbore and has production valves for producing fluids from the wellbore. A screen can be used to screen production fluids as they are produced through the production valves. The nozzles can also allows produced fluids to flow into the mandrel, or backflow valves can be used to restrict flow of produced fluids through the nozzles while permitting the flow of steam out of the nozzles.

22 Claims, 18 Drawing Sheets

DUAL-PURPOSE STEAM INJECTION AND PRODUCTION TOOL

BACKGROUND

Some hydrocarbon formations accessed by wellbores do not have adequate natural pressure to cause the hydrocarbons to rise to the surface on their own. In these wells, artificial lift systems can encourage production for such formations. For example, pumps used in the wellbore or at the well's surface can produce fluids to the surface, or gas injection into the wellbore can lighten the weight of fluids and facilitate their movement towards the surface.

In other techniques, a compressible fluid, such as pressurized steam, is injected into the wellbore or an adjacent wellbore to improve production. This is especially useful in a producing field having formations with heavy oil because the heat and pressure of the injected steam reduces the viscosity of oil.

To perform steam injection, operators isolate zones of interest at different depths in the wellbore with packers and then inject steam into the wellbore to the zones. Because each wellbore includes production zones with varying natural pressures and permeability, the amount of injected steam can vary between zones.

Although separate conduits can be used between the injection source and each zone, operators preferably use a single toolstring to carry the steam to the multiple zones. For example, FIG. 1 shows a section of a wellbore 10 having steam injection mandrels 50 according to the prior art disposed on a toolstring 20 downhole. Perforated areas of the wellbore 10 correspond to the zones to be injected with steam.

The mandrels 50 have one or more nozzles 60 that inject steam from the tubing string 20 to the zones of interest. Packers 26 isolate each zone to ensure that steam leaving the mandrel's nozzles 60 travels thorough the adjacent perforations 14 in the casing 12 to the desired zones. At the surface, surface equipment 30 controls injection pressures, injection rates, and steam quality during the steam injection operations.

FIG. 2 shows an isolated view of a prior art steam injection tool 50. This tool 50 is similar to that used in the "SteamSaver Injection System" available from the Assignee of the present disclosure. Additionally, this tool 50 is similar to the steam injection tool disclosed in commonly owned U.S. Pat. No. 6,708,763, which is incorporated herein by reference in its entirety.

The tool 50 has a tubular body 52 with apertures 54 for passage of steam. A sleeve 56 disposed on the body 52 contains the steam, which is directed to nozzles 60 on the end of the sleeve 56. Each nozzle 60 injects a predetermined amount of the steam into the wellbore, and this amount is determined in part by the supply pressure at the surface and the characteristics of the nozzles 60. An extension 70 conveys additional steam not passing through the apertures 54 further downhole from the tool 50 to other tools on the toolstring (20; FIG. 1). A diverter 72 can be disposed on this extension 70 to divert the steam exiting the nozzles 60.

Once the wellbore 10 of FIG. 1 is treated with steam using a tool 50 as in FIG. 2, the toolstring 20 is removed so a separate production string (not shown) can be run downhole to obtain production fluids. As will be appreciated, removing one toolstring and deploying another is a time consuming and expensive process. Rather than pulling the toolstring 20 and steam injection tools 50, it would be helpful if wellbore fluid could be produced with the existing toolstring in the wellbore. Unfortunately, producing fluids through a steam injection toolstring 20 with these prior art tools 50 has not been possible due to a number of problems and limitations, such as clogging, loss of steam quality, and poor production flow.

The subject matter of the present disclosure is directed to overcoming, or at least reducing the effects of, one or more of the problems set forth above.

SUMMARY

A dual-purpose tool and method can be used for steam injection and production in a wellbore on the same toolstring. A mandrel disposed on the toolstring deploys in the wellbore to communicate steam into the wellbore annulus in a steam injection operation. The mandrel can remain deployed in the wellbore to then communicate production fluid from the wellbore to the surface during production operations. In general, the tool can be run in any type of wellbore, including open or cased holes, and it can even be deployed inside tubing, a slotted liner, or the like.

A distributor on the mandrel separates inner and outer manifolds. The inner manifold transfers steam from within the mandrel's bore to the distributor and transfers production fluid in the reverse. The outer manifold transfers the steam from the distributor to the wellbore annulus and transfers production fluid in the reverse.

The distributor controls the flow of steam and production fluid between these inner and outer mandrels. To do this, nozzles on the distributor inject the steam from the inner manifold into the wellbore annulus. Additionally, production valves on the distributor produce the production fluids from the wellbore annulus into the tool. For the outer manifold, a screen can be used to screen production fluids before they are produced through the production valves. The nozzles can also allow production fluids to flow through them and into the mandrel. Alternatively, backflow valves can be used with the nozzles to prevent or restrict the flow of production fluids through the nozzles while still permitting the flow of steam out of the nozzles.

In one arrangement, a dual-purpose steam injection and production apparatus for a wellbore has a mandrel, a distributor, and a screen. The mandrel deploys in the wellbore and communicates steam and production fluid. The distributor and screen are disposed on the mandrel. The distributor permits fluid communication of the steam out of the mandrel and permit fluid communication of the production fluid into the mandrel, while the screen at least screens fluid communication of the production fluid into the distributor.

To inject steam with the apparatus, for example, the distributor can have nozzle that permits fluid communication of the steam out of the mandrel and preferably controls the flow of steam. In some implementations, the nozzle can permit fluid communication of the production fluid into the mandrel, or the nozzle can have a backflow valve that prevents fluid communication of the production fluid through the nozzle.

To produce fluid with the apparatus, the distributor can have a flow valve that prevents fluid communication of the steam out of the mandrel, but permits fluid communication of the production fluid into the mandrel. Both the nozzle and the flow valve can be used on the same distributor member, they can be used independently on separate distributor members, or they can be used together on separate distributor members.

For its part, the screen can be used to screen production fluid entering through just the nozzles, through just the production valves, or through both. In general, the screen can have a sleeve with one or more orifices communicating with the distributor and can have a screen element disposed on the sleeve adjacent the one or more orifices.

The mandrel can have inner and outer bodies. The inner body defines a bore and has at least one port communicating the bore outside the inner body. The outer body is disposed on the inner body and communicates the at least one port with the distributor.

The apparatus can be disposed on a toolstring deploying in the wellbore, and at least one isolation element can isolate portions of the wellbore annulus. In this way, steam injection and production operations deploy the apparatus in the wellbore. When the at least one isolation element is set, steam is injected from the nozzle on the apparatus into the wellbore. When production operations commence, production fluid from the wellbore is screened into the apparatus. This can be done without the need to run another toolstring.

In another arrangement, a dual-purpose steam injection and production apparatus for a wellbore has a mandrel and a distributor, but may or may not have a screen. As before, the mandrel deploys in the wellbore and communicates steam and production fluid. The distributor disposed on the mandrel has at least one nozzle and at least one flow valve. The nozzle permits fluid communication of the steam out of the mandrel. The flow valve, however, prevents fluid communication of the steam out of the mandrel and permits fluid communication of the production fluid into the mandrel.

The foregoing summary is not intended to summarize each potential embodiment or every aspect of the present disclosure.

DETAILED DESCRIPTION

Figure 1:
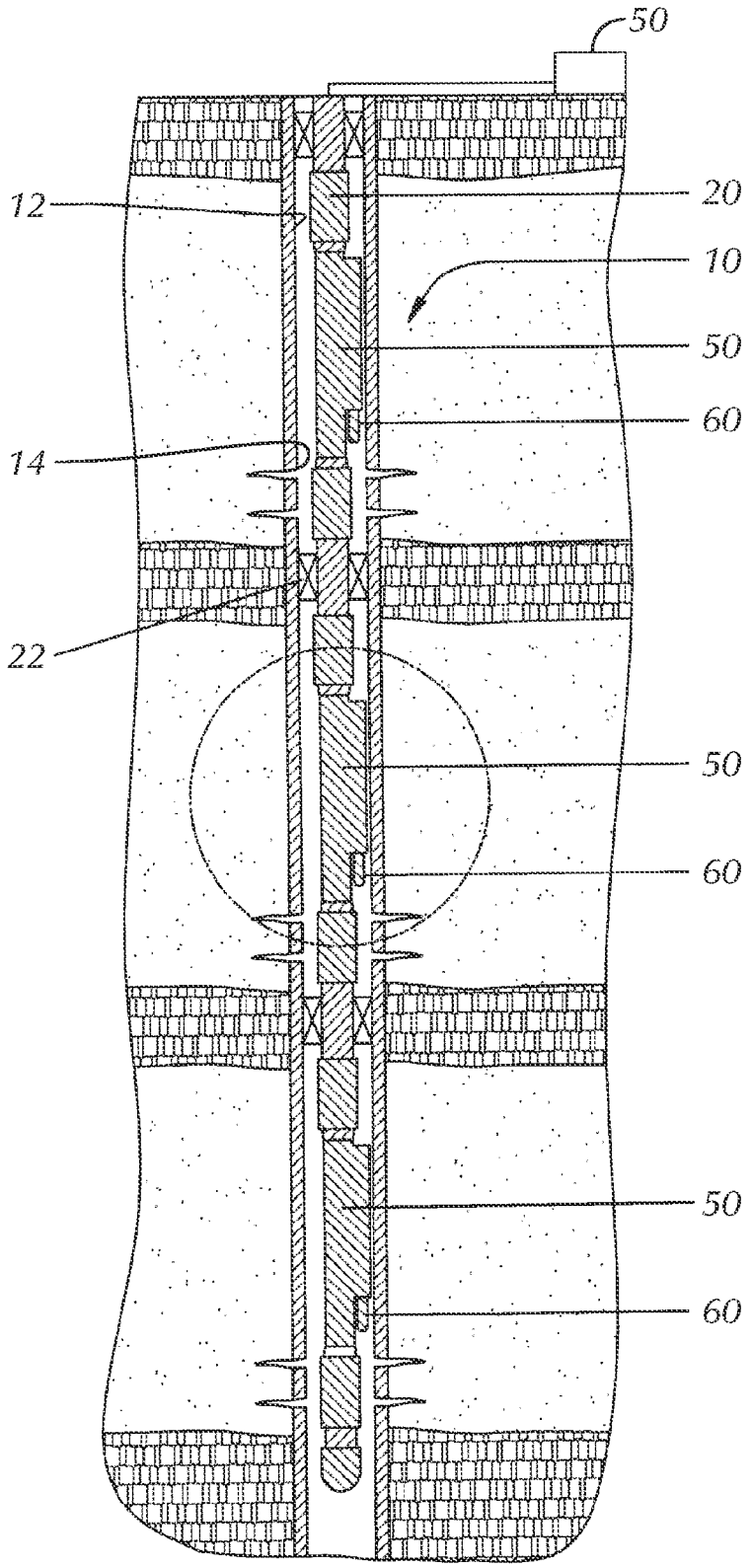
FIG. 1 (Prior Art)
FIG. 1 shows a wellbore having steam injection tools according to the prior art.
Figure 2:
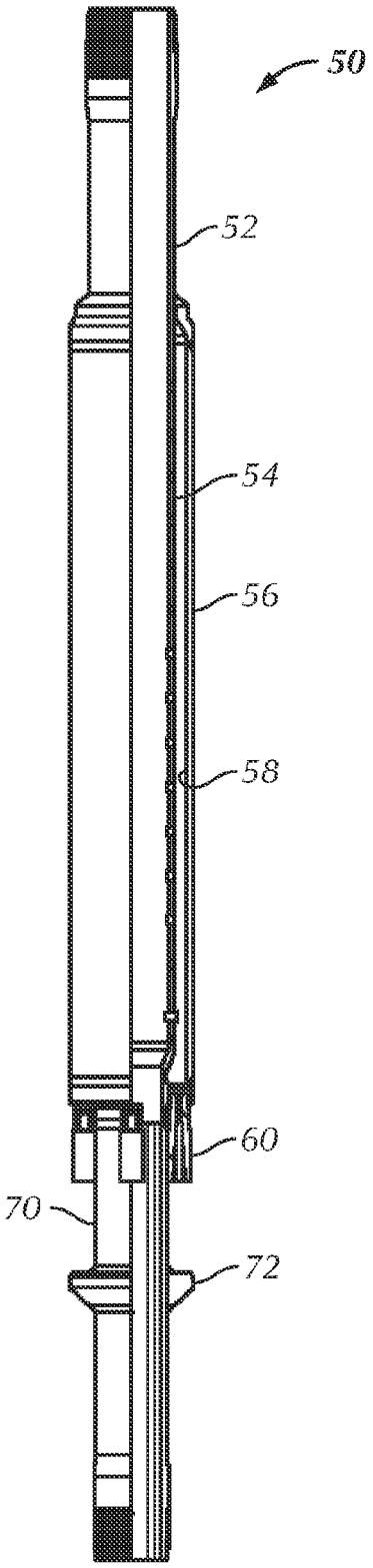
FIG. 2 (Prior Art)
FIG. 2 is partial cross-sectional view of a prior art steam injection tool.
Figure 3:
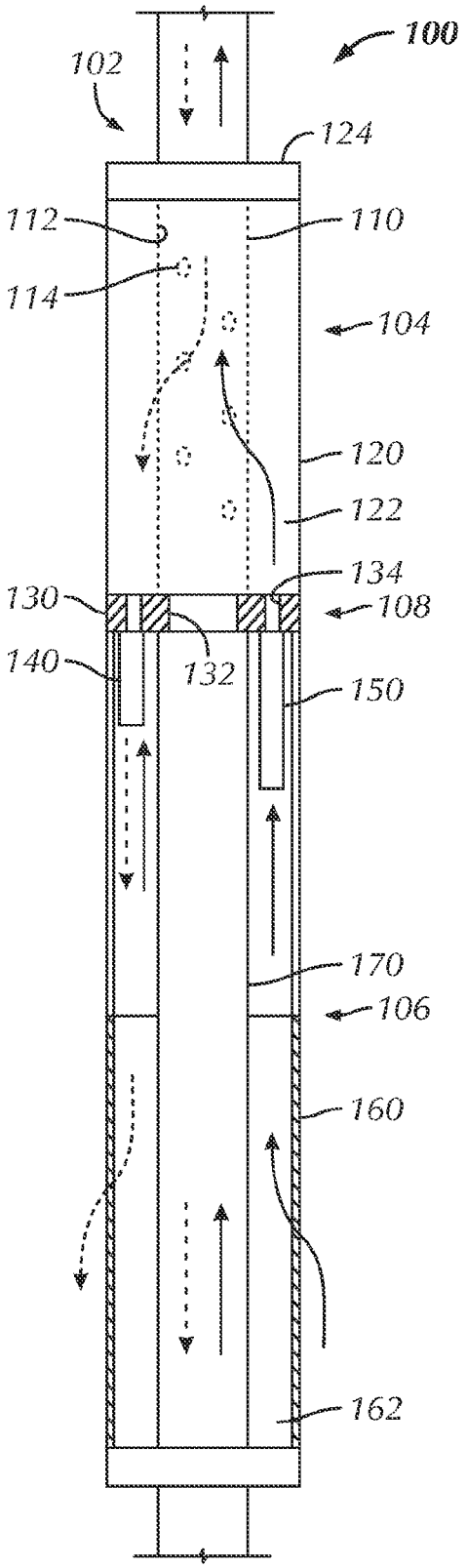
FIG. 3 schematically illustrates a dual-purpose steam injection and production tool according to certain teachings of the present disclosure.

A dual-purpose tool 100 in FIG. 3 can be used for steam injection and production in a wellbore while deployed on the same toolstring (not shown). The tool 100 couples to other components of the toolstring (not shown), such as other tools, tubulars, isolation elements (e.g., packers), and the like. When deployed downhole, the tool 100 can inject steam pumped down the toolstring into the wellbore annulus. After steam injection, the tool 100 can then produce fluid from the wellbore annulus without the need to lift the tool 100 out of the wellbore and replace it with a production string.

Although one tool 100 is shown, it will be appreciated that steam injection and production operations can use a number of such tools 100 disposed along the toolstring. Moreover, additional components, such as thermal packers, cup packers, expansion joints, and the like, will also be used on the toolstring as will be understood. For example, the toolstring may have thermal packers with integral expansion joints or may have thermal cup packers with separate expansion joints located between injection zones to isolate them from one another. Moreover, surface equipment known in the art can control injection pressures, injection rates, and steam quality and handle production of produced fluids.

Turning to the tool 100 in more detail, the tool 100 has a mandrel 102 with a distributor 108 disposed between an inner manifold 104 and an outer manifold 106. The mandrel 102 conveys steam and fluids through the tool 100. The inner manifold 104 transfers the steam and fluids within the tool 100, while the outer manifold 106 transfers the steam and fluid between the tool 100 and the wellbore annulus. For its part, the distributor 108 controls the flow of the steam and fluids between the two manifolds 104 and 106.

Looking first at the inner manifold 104, an outer sleeve 120 is disposed on an inner body 110 so that an annular space 122 is formed therebetween. Ports 114 along the inner body 110 communicate the body's bore 112 with this annular space 122 so injected steam or produced fluids can pass therebetween. The size, number, and arrangement of these ports 114 are selected to provide critical flow for steam injection as well as to facilitate the flow of production fluids and can vary depending on the implementation.

Steam conveyed down the inner body 110 can pass through the ports 114 and into the annular space 122. In a reverse manner, production fluid in the annular space 122 can pass through the ports 114 and into the inner body's bore 112 to be conveyed uphole in the mandrel 102. One end of the annular space 122 is closed by an end cap 124 disposed on the sleeve 120 and body 110.

For the distributor 108, a distributor cap 130 is disposed between the inner and outer manifolds 104 and 106 and exchanges steam and fluid between the manifolds 104 and 106. The distributor cap 130 has channels 134 defined about an inner passage 132. The channels 134 communicate with the annular space 122 between the inner manifold's bodies 110 and 120. However, the cap's inner passage 132 communicates with the inner body 110 so its bore 112 can communicate with a tubular extension 170, which connects further downhole to additional components (e.g., another tool or additional tubular).

The nozzles 140 and production valves 150 on the distributor cap 130 communicate the inner manifold's space 122 with the outer mandrel's space 162 between the tubular extension 170 and a screen 160. Affixed to the distributor cap 130 and disposed along the extension 170, this screen 160 allows steam and fluid to flow through it and separates the nozzles 140 and valves 150 from the downhole wellbore annulus surrounding the tool 100.

When the tool 100 is deployed downhole for a steam injection operation, injected steam passes through the inner body's bore 112, and some of the steam exits the ports 114 into the bodies' annulus 122 of the inner manifold 104. (Additional steam can bypass the mandrel's ports 114 and pass through the extension 170 to further downhole portions of the toolstring.)

In the annular space 122, the injected steam contained by the sleeve 120 then exits the nozzles 140 into the annular space 162 between the extension 170 and screen 160. At this point, the injected steam passes through the screen 160 to treat the formation in the surrounding wellbore annulus. As noted previously, this injected steam can reduce the viscosity of heavy oil, which can facilitate production during later operations.

As detailed later, the nozzles 140 are preferably venturi-style nozzles designed to maintain critical flow of the injected steam according to the purposes of the steam injection operation. All the while, however, the production valves 150 restrict fluid flow of the steam in the manifold space 122 from passing through them. This can help ensure that a proper number of exits for the injected steam provided by the nozzles 140) is used to inject the steam so that critical flow, quality, and other desirable features of the steam injection operation can be maintained.

Once steam injection is complete, the tool 100 can then be used for production without the need to remove the tool 100 from the wellbore. Because clogging from production fluids can be a concern, the screen 160 filters the production fluid from the wellbore annulus as it enters the tool 100. For this reason, the screen 160 can be particularly suited to meet and filter the expected sands, fines, and other particles to be encountered downhole in the particular wellbore. Once filtered by the screen 160, the production fluid passes from the screen annulus 162, through the nozzles 140, and into the inner manifold's space 122. Likewise, to increase the flow area through the distributor cap 130, the production valves 150 open in response to reverse pressure from the production fluid and permit the screened fluid to enter the inner manifold's space 122. Once in the manifold 104, this production fluid can pass through the ports 114 and into the tool's bore 112 to be produced at the surface.

As will be appreciated, the steam injection operation must maintain pressures, temperatures, rates, and quality of the steam as it is delivered downhole and injected through the various tools 100 for the operation to be beneficial. Loss of any of these desired characteristics of the steam may prevent an adequate application of pressure and temperature to the zones of interest. As noted herein, these considerations require certain sizes and number of ports 114, certain numbers of nozzles 140, and certain shapes of those nozzles 140 to accomplish the necessary results.

Unfortunately, simply producing fluid back through the ideal configuration for steam injection may cause clogging and/or limited production of production fluid. For this reason, the disclosed tool 100 balances the two opposing operations of steam injection and production in the same tool 100 so that the goals of both operations can be achieved. As noted previously, such has not been the case in the prior art, where separate toolstrings are used for the separate operations.

With an understanding of the tool 100 and how it can be used for the dual purposes of injecting steam and producing fluid in a wellbore, discussion now turns to some particulars of the tool's components.

Figure 4A:
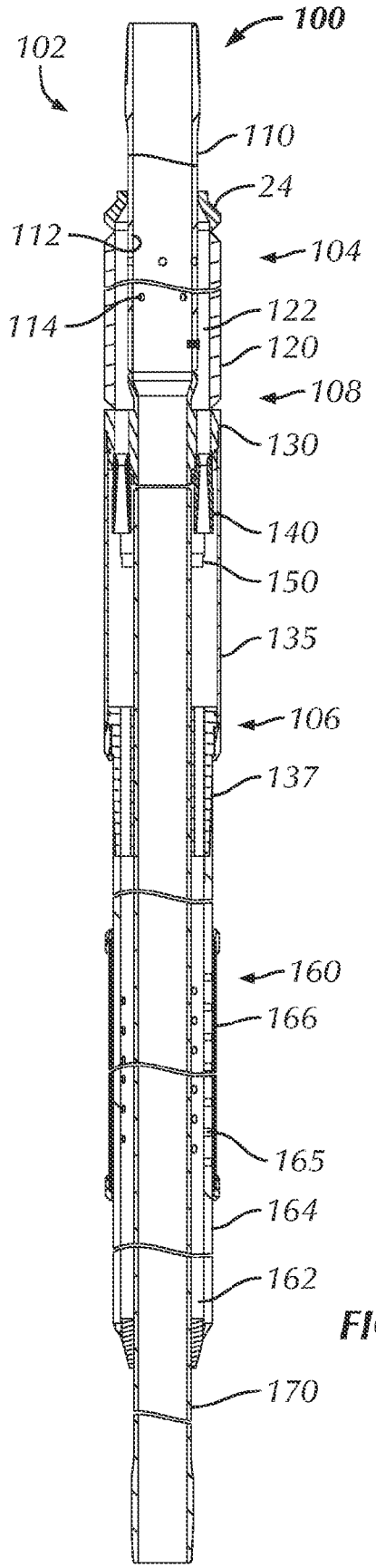
FIG. 4A is a cross-sectional view of a first configuration of the dual-purpose tool.

FIGS. 4A-4F show a first configuration of a dual purpose tool 100A in additional detail. This first tool 100A is similar to that discussed above with reference to FIG. 3 so that like reference numerals are used for similar components. As shown in FIG. 4A, the tool 100A has the mandrel 102, the distributor cap 130, the injection nozzles 140, the production valves 150, and the screen 160. (For clarity, however, the screen 160 and some other components of the outer manifold 106 are not shown in FIGS. 4B-4C to reveal details of the nozzles 140 and production valves 150.)

Starting from the uphole end of the tool 100A, the end cap 124 welds to the inner manifold's sleeve 120 and the tubular body 110, and the tubular body 110 and the sleeve 120 weld to the distributor cap 130. The extension 170 attaches or welds to the other side of the distributor cap 130, and the various nozzles 140 and valves 150 thread into the distributor cap's channels 134.

As shown in FIG. 4A, an intermediate sleeve 135 connects from the distributor cap 130 and attaches to a connector 137, and the screen 160 affixes to this connector 137. The connector 137 has a number of passages therethrough. These components make the tool 100A modular and facilitates it assembly, but other arrangements could be used instead.

Here at the outer mandrel 106, the screen 160 includes an outer sleeve 164 with a number of radial orifices 165 and includes a screen member 166 disposed about this outer sleeve 164 and covering the orifices 165. Steam in the annular space 162 between the outer sleeve 164 and extension 170 can pass out the orifices 165 and through the screen element 166 to the wellbore annulus. Similarly, production fluids can pass through the screen element 166 and orifices 165 and into the annular space 162. Other assemblies for the screen 160 disclosed herein could be used, including, but not limited to, a well screen, a sand control screen, a gravel pack screen, a wire-wrapped screen, a mesh screen, an expandable sand screen, an inflow control device (ICD), a slotted liner, a perforated pipe, and combinations thereof. Moreover, more than one screen 160 can be used on the tool 100A, and a given screen 160 can have more than one section of orifices 165 and screen elements 166 other than as shown.

Figure 4B:
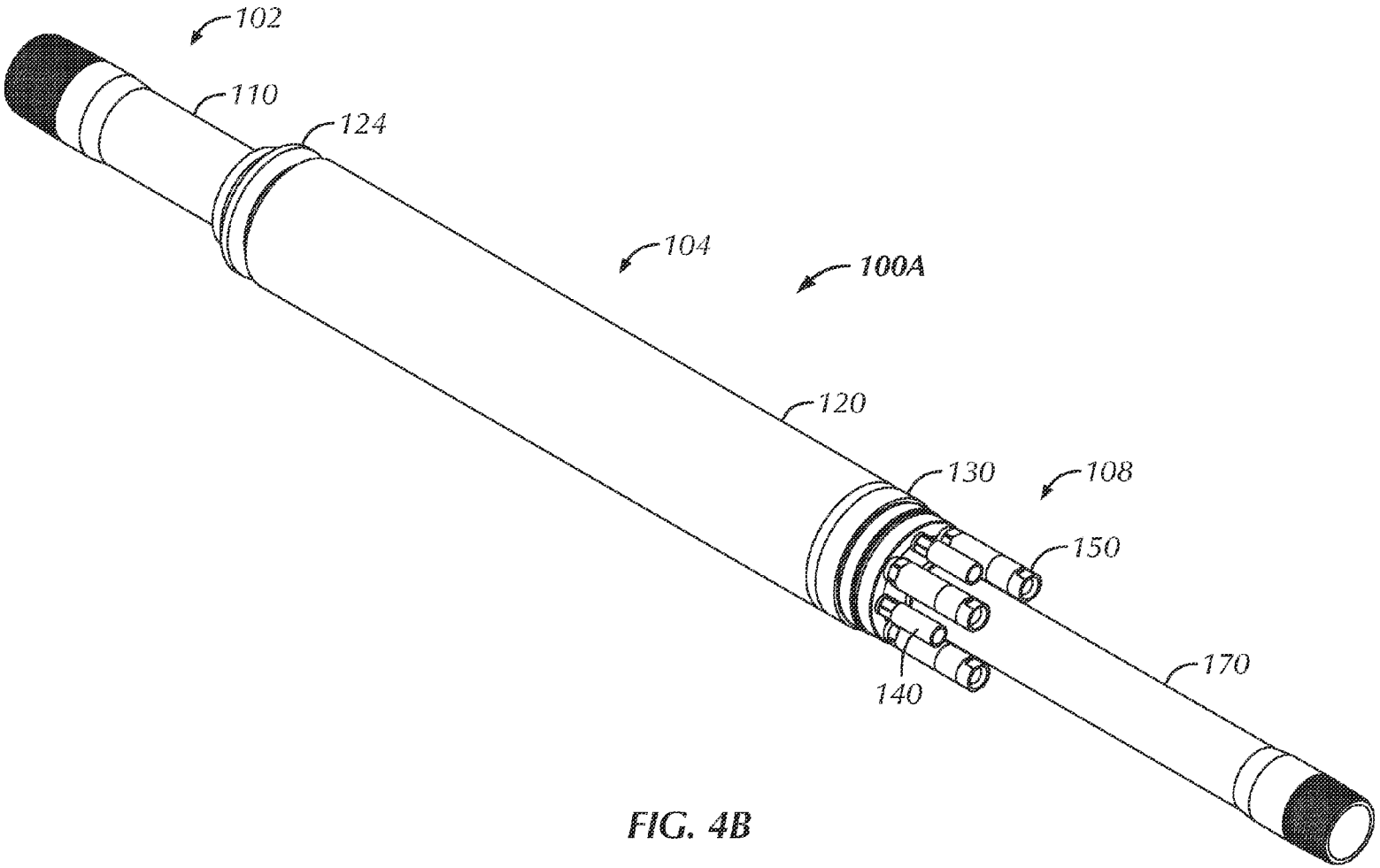
FIGS. 4B-4F show portions of the dual-purpose tool of FIG. 4A in perspective, side, first and second cross-sectional, and end sectional views.
Figure 4C:
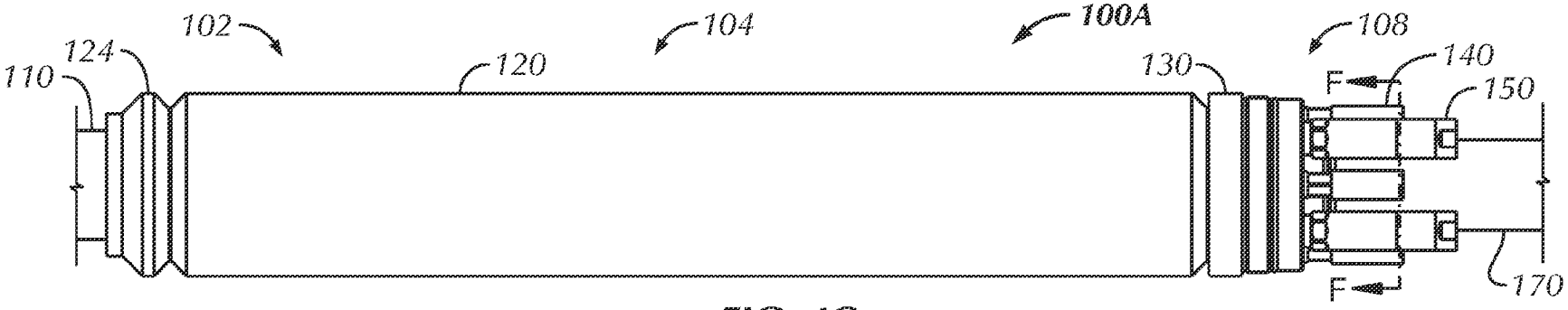
Figure 4D:
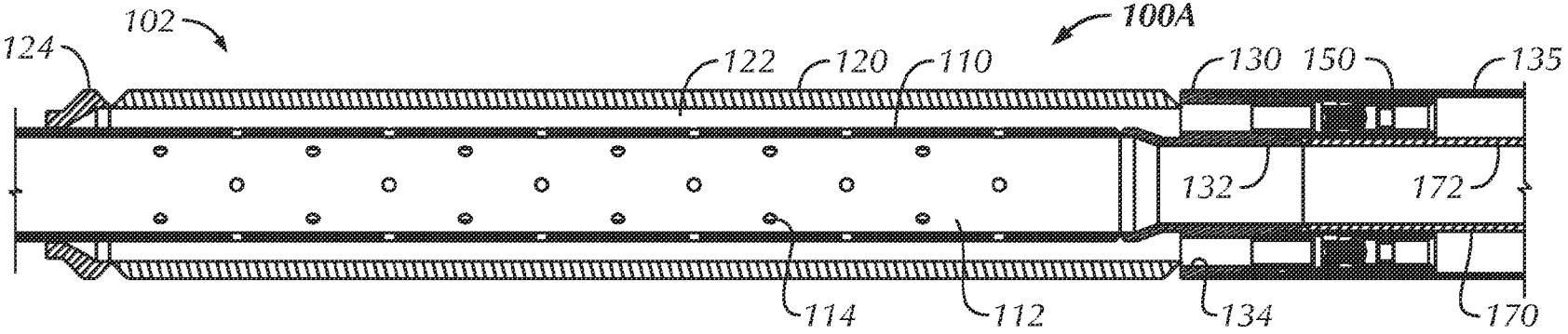
Figure 4E:
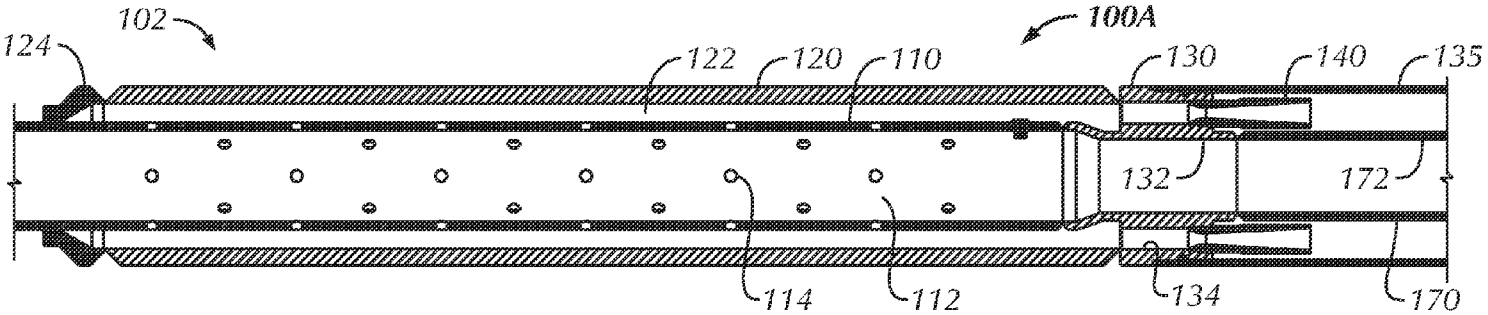
Figure 4F:
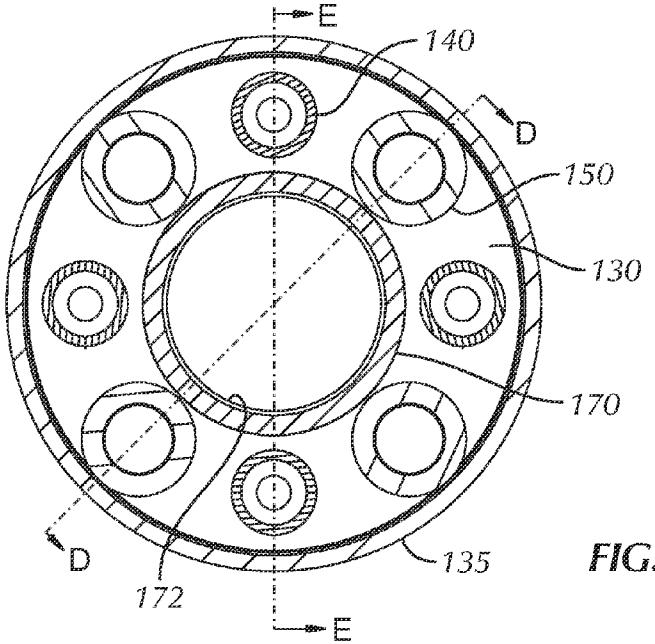

FIG. 4B reveals that several nozzles 140 and valves 150 are disposed in the distributor cap 130 to communicate flow. As shown in FIG. 4F, four nozzles 140 and four valves 150 can be arranged alternatingly about the distributor cap 130, although other arrangements could be used. Nevertheless, a symmetrical arrangement may have advantages for some implementations.

Figure 5:
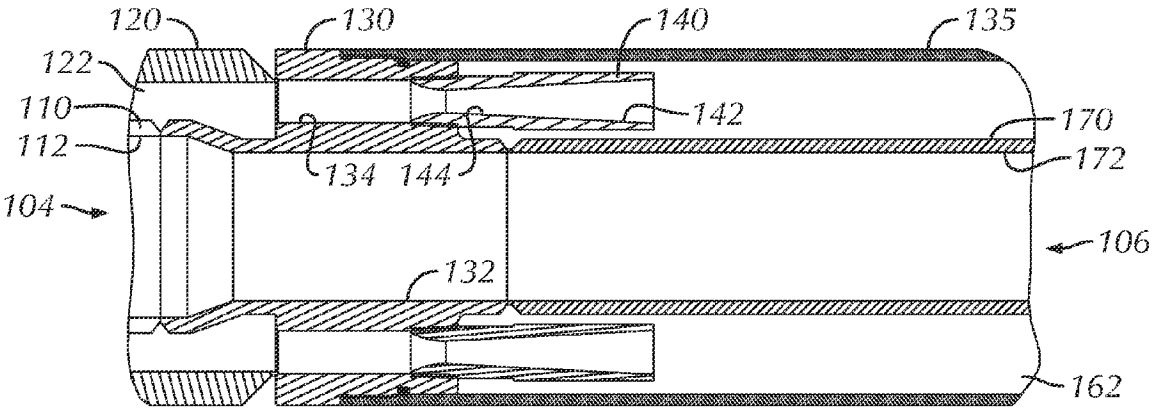
FIG. 5 shows a cross-sectional detail of the injection nozzle.

Turning to FIG. 5, details of the nozzles 140 disposed in the distributor cap 130 are shown. As can be seen, the nozzles 140 thread into the distributor cap's channels 134, as noted previously. This allows the nozzles 140 to be installed as the tool 100A is made up so the tool 100A can be configured or modified for the operation at hand.

During steam operations, steam contained in the annular space 122 of the inner manifold 104 can pass through the distributor cap's channels 132, through the nozzles 140, and into the space 172 between the extension 170 and intermediate sleeve 135. During reverse flow from production, however, production fluid contained in this space 172 can pass through the nozzles 140 and into the mandrel's annular space 122.

Each nozzle 140 defines a venturi-style passage 142 having a throat 144. The contour of this passage 142 and its throat 144 are designed to recover pressure of the steam contained in the inner space 122 so the tool 100A can achieve a more constant rate of steam for the operation with less pressure differential during the steam injection. In particular, the amount of steam entering downhole zones during steam injection can be difficult to control because any zones with higher natural pressure or lower permeability may not receive enough steam. Therefore, a critical flow of steam preferably passes through the nozzles 140 so sufficient steam can be applied to the zones of interest.

During critical flow, the sonic velocity of the compressible steam's flow through at least one location of the nozzle 140 is preferably equal to the speed of sound of the fluid at local fluid conditions. In other words, the Mach number of the fluid is preferably 1.0 at the throat 144 (or smallest restriction) of the nozzle 140. To attain this critical flow, the nozzles 140 should maintain a preferred ratio of pressures between the wellbore annulus and the toolstring. In some cases, the preferred ratio is at least greater than 0.56. (Additional details of how the nozzle 140 is designed can be found in U.S. Pat. No. 6,708,763, which is incorporated herein by reference in its entirety.)

Looking at the production valve 150 shown in detail in FIG. 6A-6D, the production valve 150 restricts the flow of steam from the inner manifold 104 and permits the flow of production fluid from the outer manifold 106 as noted previously. The valve 150 can use any type of valve to permit fluid flow in one direction and prevent or restrict fluid flow in an opposite direction. As shown in detail in FIGS. 6B-6C, for example, the valve 150 can be a check valve having a ball 154 biased by a spring 156 relative to a seat 152.

During steam injection, pressure from the steam enters the proximal end 151b of the valve 150 from the inner manifold 104. The steam acts against the ball 154, pushing it along with the bias of the spring 156 against the seat 152. The seating of the ball 154 in this way prevents the injected steam from passing out of the valve 150 during steam operations. Instead, injected steam can only pass through the nozzles (140) so that the steam injection can be controlled as noted previously.

Figure 6A:
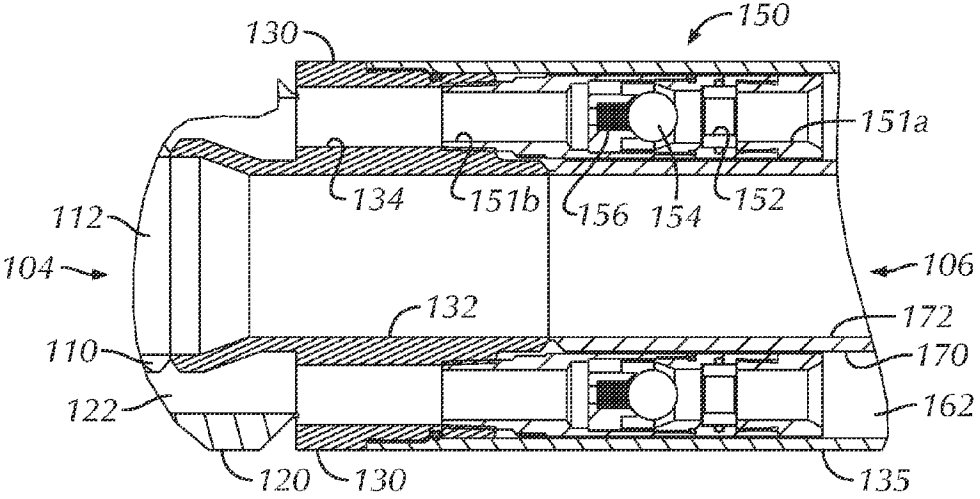
FIGS. 6A-6D show details of the production valve.
Figure 6B:
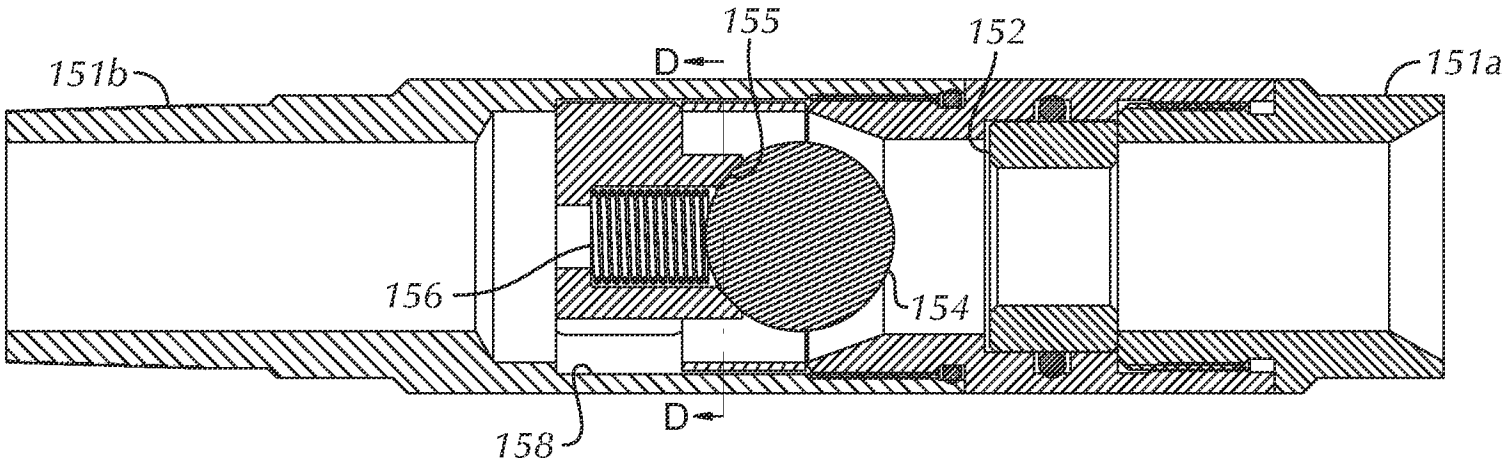
Figure 6C:
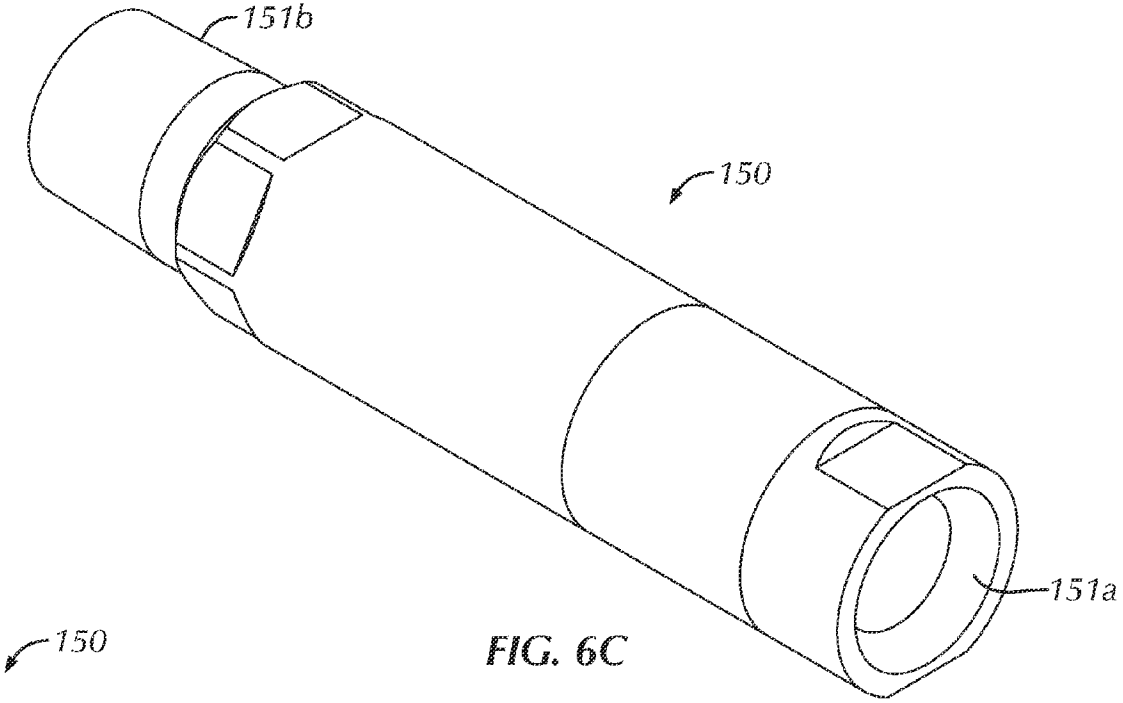
Figure 6D:
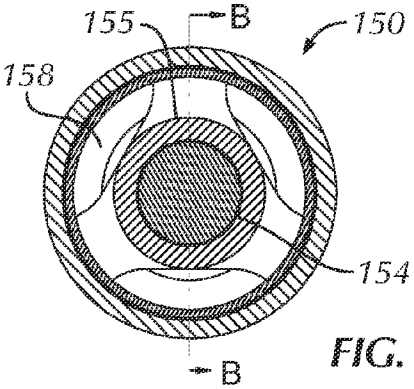

During backflow as shown in FIG. 6B, production fluid enters the valve's distal end 151a from the outer manifold (106), and pressure from the production fluid moves the ball 154 away from the seat 152 against the bias of the spring 156. With the ball 154 moved, it can eventually set against a fixed rest 155. Production fluid at this point entering the valve's distal end 151a can pass through bypasses 158 in the fixed rest 155 so the fluid can pass out the valve's proximal end 151 b to the tool's inner manifold 104 (FIG. 6A).

The first tool 100A discussed above in FIGS. 4A-4F has the production valves 150 and the screen 160 in addition to the nozzles 140 to handle steam injection and production. Other configurations are also possible depending on the implementation, characteristics of the wellbore, and aspects of the fluids downhole. A number of these other configurations are discussed below.

Figure 7:
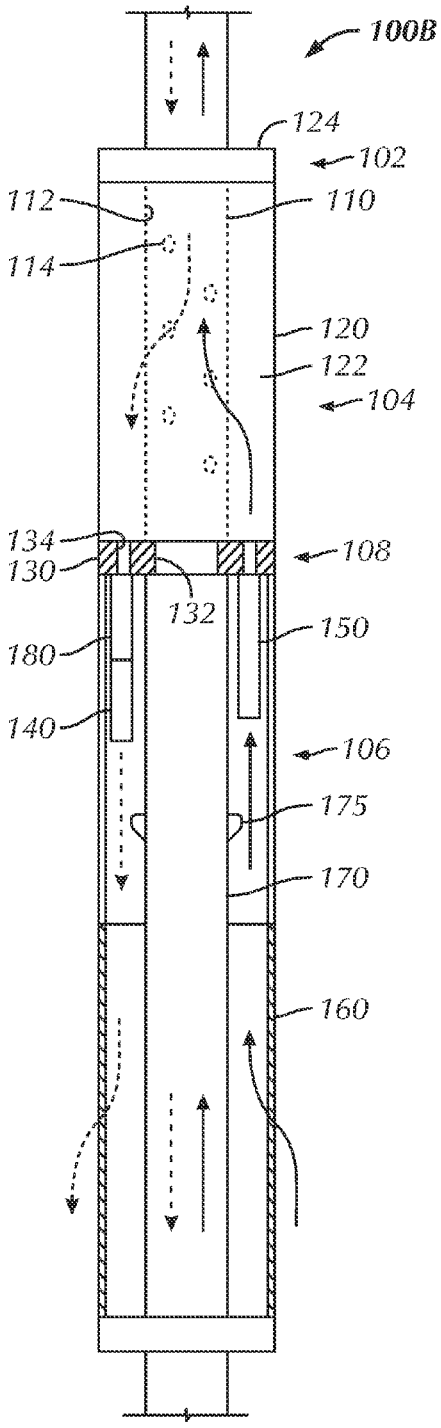
FIG. 7 schematically illustrates a second configuration of the dual-purpose tool having injection nozzles, backflow valves, production valves, and a screen.
Figure 8A:
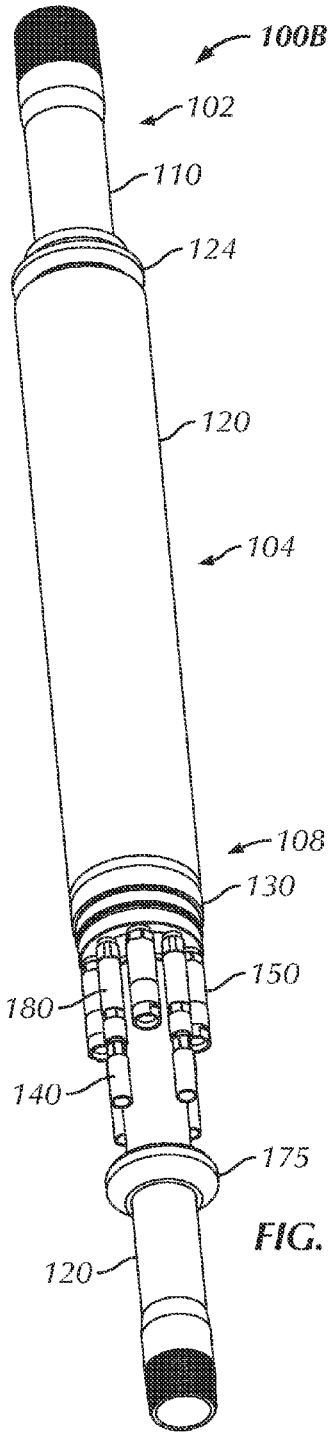
FIGS. 8A-8D show portions of the dual-purpose tool of FIG. 7 in side, perspective, and first and second cross-sectional views.
Figure 8B:
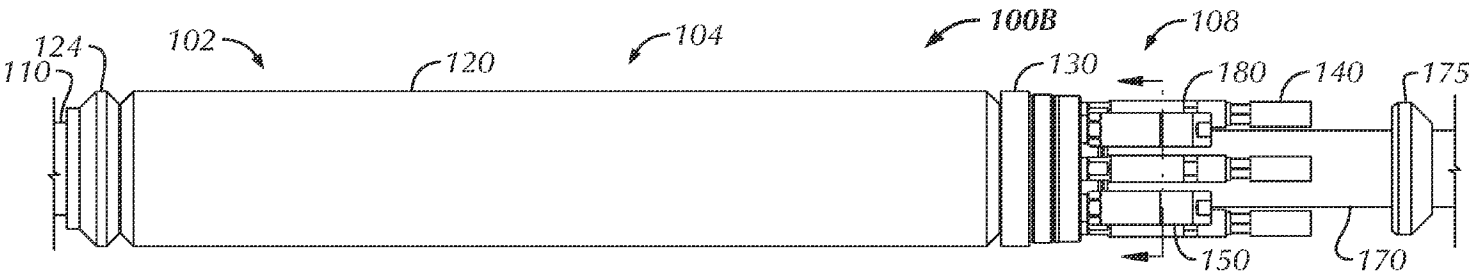
Figure 8C:
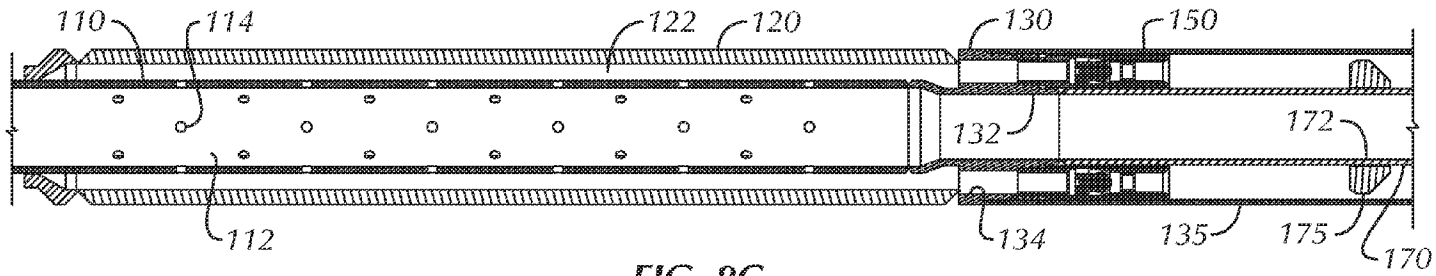
Figure 8D:
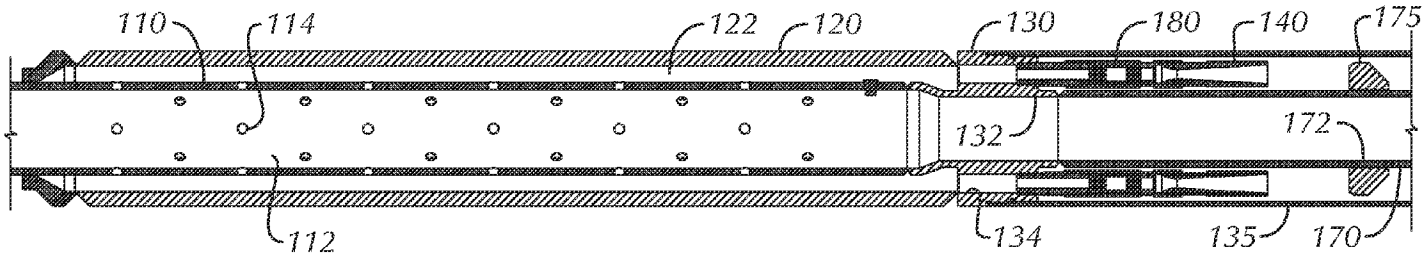

In FIG. 7, a second configuration of a dual-purpose tool 100B for steam injection and production is similar to the first tool 100A of FIGS. 4A-4F so that the same reference numerals are used. As before, this tool 100B has a mandrel 102, injection nozzles 140, production valves 150, and screen 160. As one difference, this tool 100B has a diffuser 175 for the steam, which may or may not be used on this and other tools.

In another difference, this tool 100B restricts flow of the production fluid through the nozzles 140, rather than letting production fluid pass from the screen 160 and through the nozzles 140 as with the previous tools. In particular, backflow valves 180 install on the nozzles 140. During steam injection, the backflow valves 180 permit steam to flow out of the nozzles 140. During production, however, the backflow valves 180 restrict production fluid from flowing into the nozzles 140. This can avoid issues of the nozzles 140 clogging with production fluid.

Further details of this tool 1008 are shown in FIGS. 8A-8D, which illustrate portions of the second tool 1008 without the screen (160) to reveal features of the nozzles 140, production valves 150, and backflow valves 180. As before, like reference numerals are used for similar components of previous tools so their description is not repeated here.

Figure 9A:
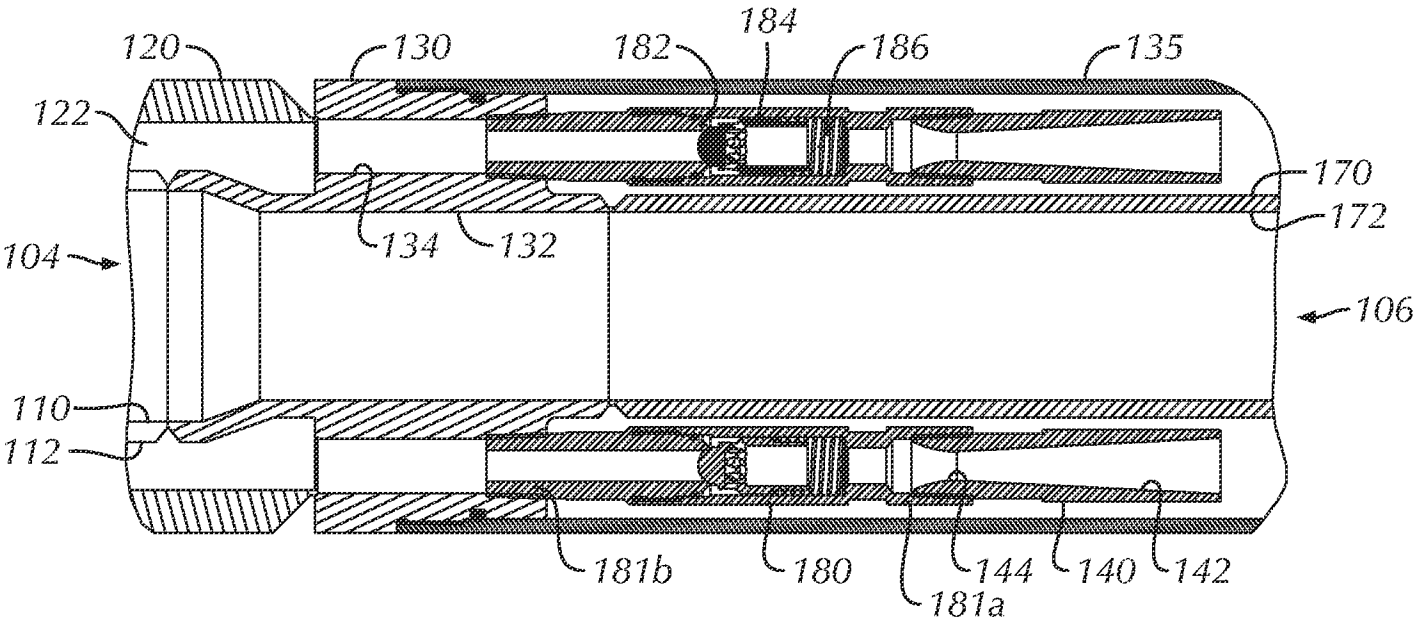
FIGS. 9A-9C show details of the backflow valve.
Figure 9B:
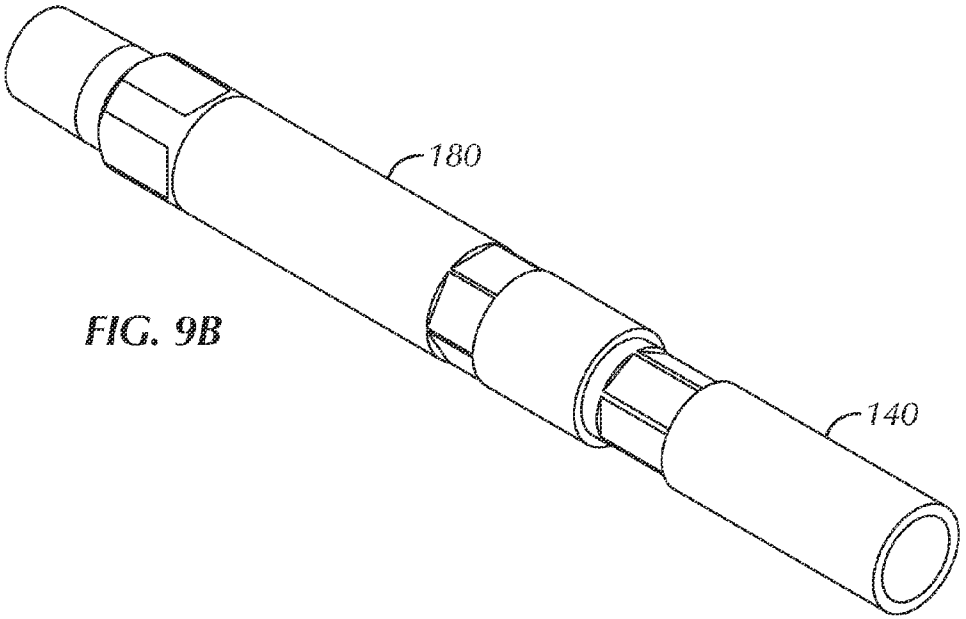
Figure 9C:
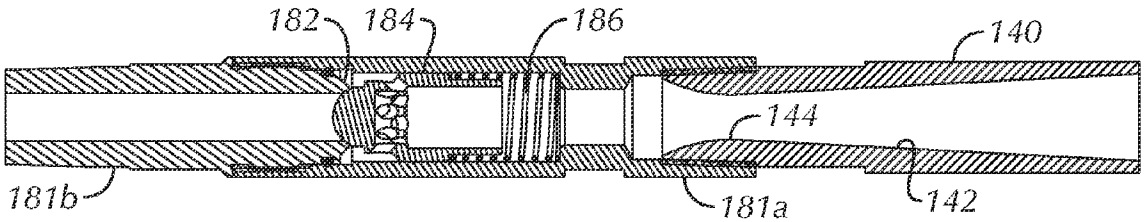

Various valve types can be used for the backflow valve 180 on the nozzles 140. As shown in FIGS. 9A-9C, for example, the backflow valve 180 can be a check valve disposed between the distributor cap 130 and the nozzle 140. The valve's proximal end 181b threads into the distributor cap's channel 134, and the nozzle 140 threads into the valve's distal end 181a. To control flow internally, the valve 180 has a dart 184 biased by a spring 186 relative to a seat 182. The bias provided by the spring 186 is intended to keep the valve 180 in the closed state in the absence of pressure from steam at the valve's proximal end 181b.

During steam injection when steam enters the valve's proximal end 181b, pressure from the steam moves the dart 184 away from the seat 182 against the bias of the spring 186. With the dart 184 moved, steam can pass through flow passages 185 in the dart 184 and out the nozzle 140.

In the absence of steam, the dart 184 seats. During production, production fluid pressure entering the nozzle 140 and the valve's distal end 181a acts against the seated dart 184, which further seats it. This prevents reverse flow through the nozzle 140 and valve 180 so that the nozzle 140 is less likely to become clogged during production.

Figure 10:
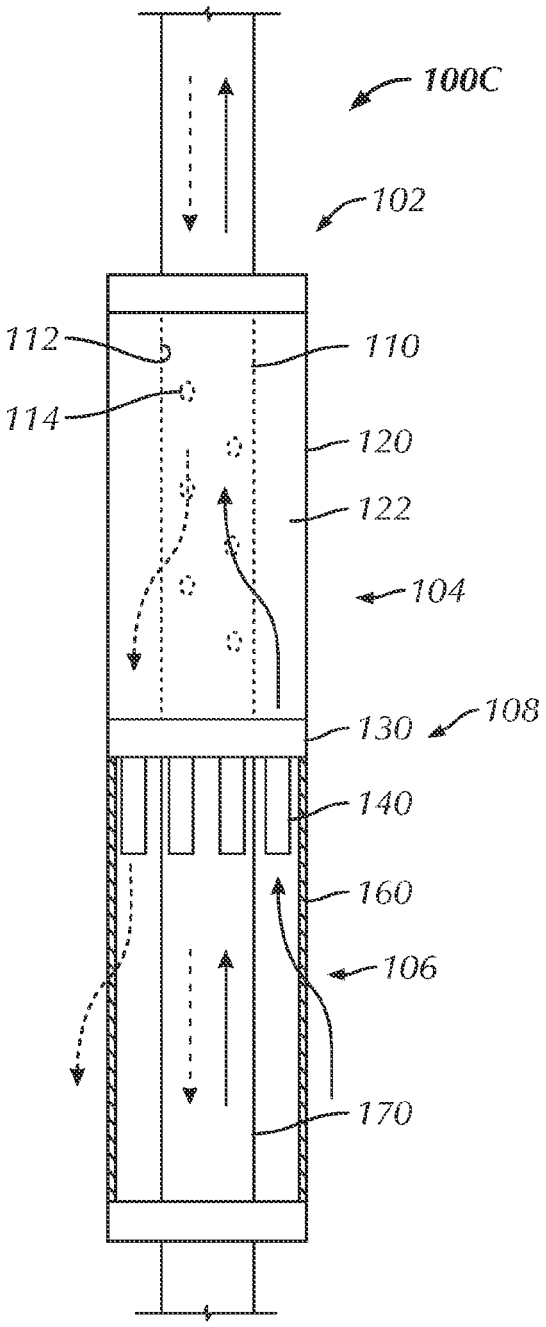
FIG. 10 shows a third configuration of the dual-purpose tool having injection nozzles and a screen.

In some implementations, issues with clogging and the need for increased flow of production fluid may present less of a problem so that production valves 150 may not be needed on the tool 100. For example, FIG. 10 shows a third configuration of a dual-purpose tool 100C, which has a mandrel 102, injection nozzles 140, and screen 160—each of which can be similar to previous tools. Notably, this tool 100C lacks production valves (150) on the distributor cap 130. Instead, the injection nozzles 140 are intended to inject steam in one direction and pass production fluids in the other direction. To deal with sand, particles, and the like, the production fluid still passes through the screen 160 disposed on the tool's outer mandrel 106.

In other implementations, issues with clogging may present less of a problem so a screen (160) may not be needed on the tool 100. Yet, increased flow of production fluid may still be needed. Therefore, a fourth configuration of a dual purpose tool 100D of FIG. 11 has a mandrel 102, injection nozzles 140, and production valves 150—each of which can be similar to previous tools. Here, the tool 100D lacks a screen (160) to filter the production fluids flowing into the distributor 108.

Figure 11:
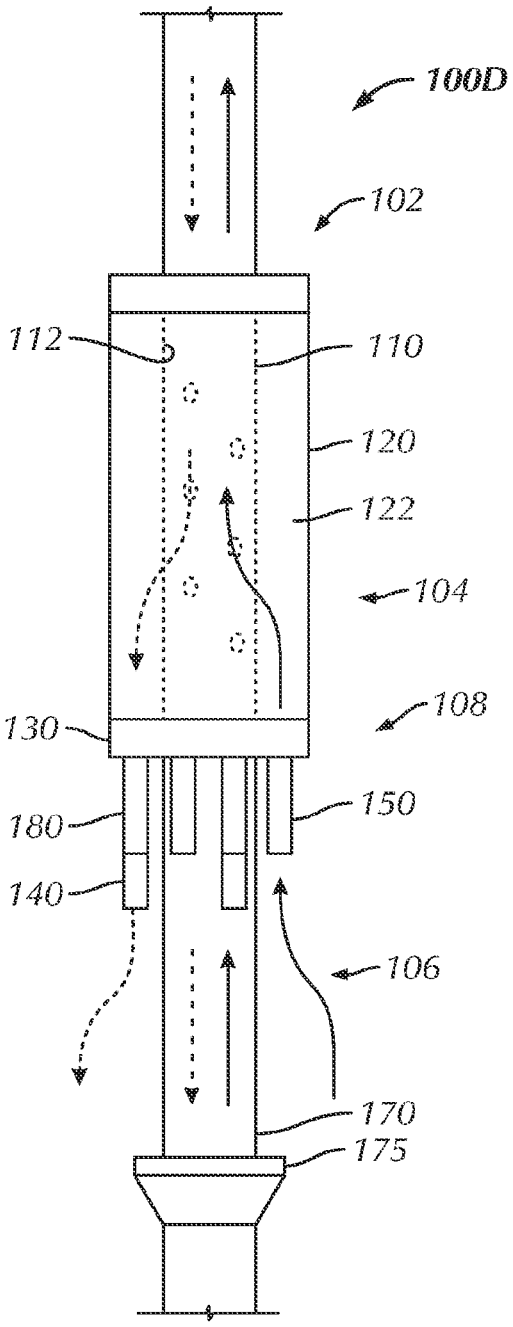
FIG. 11 shows a fourth configuration of the dual-purpose tool having injection nozzles and production valves.

In FIG. 11, the nozzles 140 have the backflow valves 180 (FIGS. 9A-9C) discussed previously to minimize clogging. As an alternative, such backflow valves 180 may not be used with the nozzles 140 so that steam and production fluid can pass through the nozzles 140. For some of the conditions downhole, using the backflow valves (180) and not the screen (160) may have some benefits. Depending on the sand, fines, and other materials expected downhole, for example, the increased flow provided by the production valves 150 may prevent or minimize any clogging of the nozzles 140 that may occur. Thus, use of a screen (160), although preferred, may not be needed for such an implementation.

In each of the previous tools 100, the nozzles 140, production valves 150, and screen 160 have been disposed toward one end of the mandrel 102—namely, toward the downhole end. The reverse arrangement can alternatively be used depending on the implementation so the components of nozzles 140, production valves 150, and/or screen 160 can be disposed toward an uphole end of the mandrel 102. Moreover, a split configuration can be used as discussed below.

Figure 12:
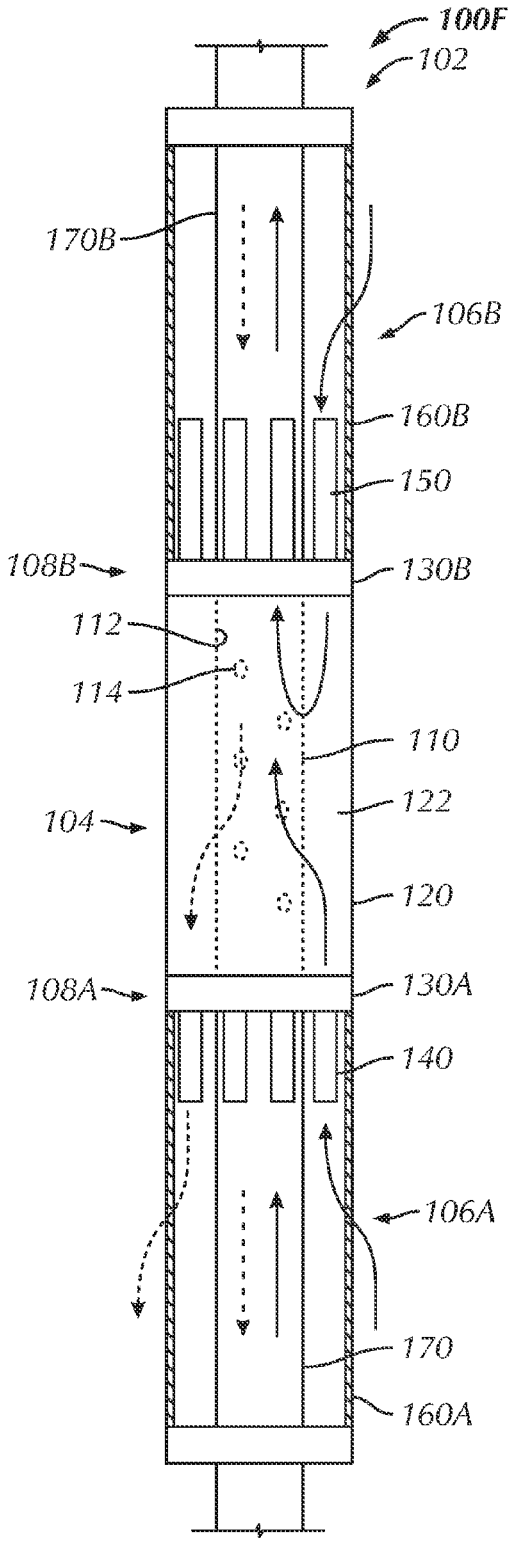
FIG. 12 shows a fifth configuration of the dual-purpose tool having injection nozzles, screen, and production valves on opposing ends of the tool.

As shown in FIG. 12, for example, a fifth configuration of a dual-purpose tool 100E again has a mandrel 102, injection nozzles 140, production valves 150, and a screen 160. Here, the mandrel 102 has distributor and outer manifold sections 106A-108A/106B-108B on the ends of the inner manifold 104. The distributor sections 108A-B include distributor caps 130A-B disposed at opposing ends of the sleeve 120 so the annular space 122 communicates at both ends of the tool's mandrel 102. One distributor cap 130A has channels (not shown) for the injection nozzles 140, while the other distributor cap 130B has channels (not shown) for the production valves 150.

Extensions 170A-B extend opposite one another from the distributor caps 130A-B to attach to other components.

The outer manifold sections 106A-B include one screen member 160B provided for the tool 100E at the end having the production valves 150. If production fluid is intended to enter the tool 100E through the injection valves 140, then another screen member 160A can be provided for the other manifold section 106A at the end of the tool 100E having the injection nozzles 140 as shown.

Figure 13:
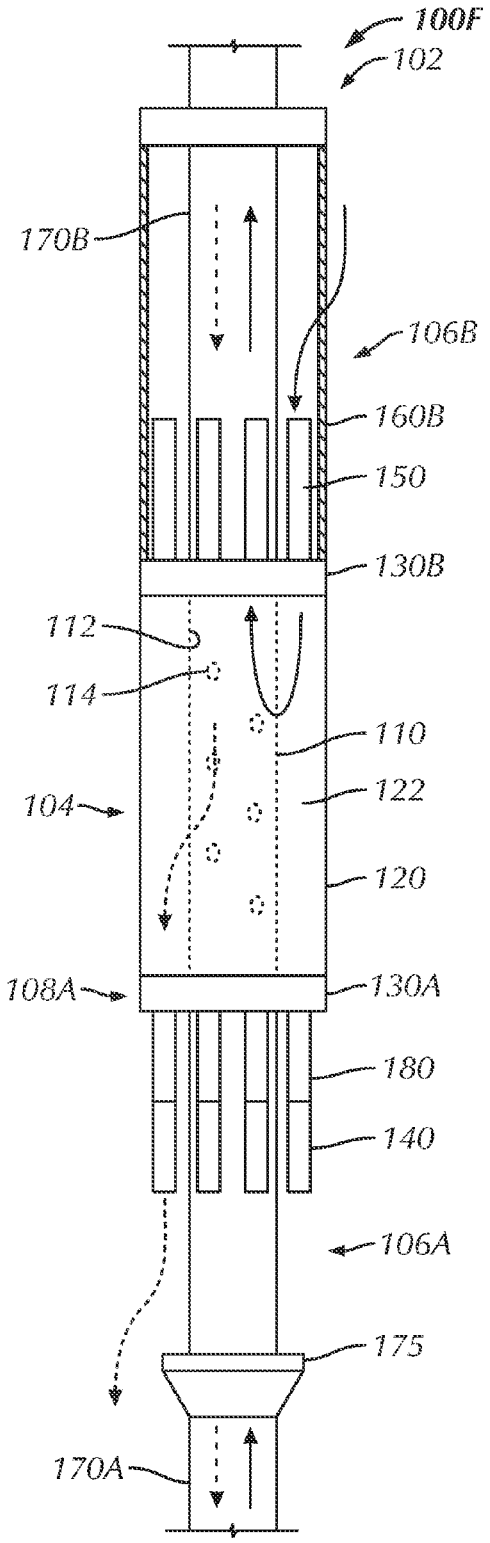
FIG. 13 shows a sixth configuration of the dual-purpose tool having injection nozzles, screen, production valves, and backflow valves on opposing ends of the tool.

Although not shown, both distributor caps 130A-B could each have a combination of nozzles 140 and production valves 150. Alternatively, no screen member may be used on one or both of ends of the tool 100E. As shown in FIG. 13, for example, one outer manifold section 106A of a tool F may lack a screen member. Instead, the injection nozzles 140 on this sixth configuration of a dual-purpose tool 100F can have the backflow valves 180 as discussed previously to prevent or restrict flow of production fluid into the tool 100F through these nozzles 140. The other manifold section 106B has a screen member 160B, although it may not use one depending on the implementation.

Figure 14:
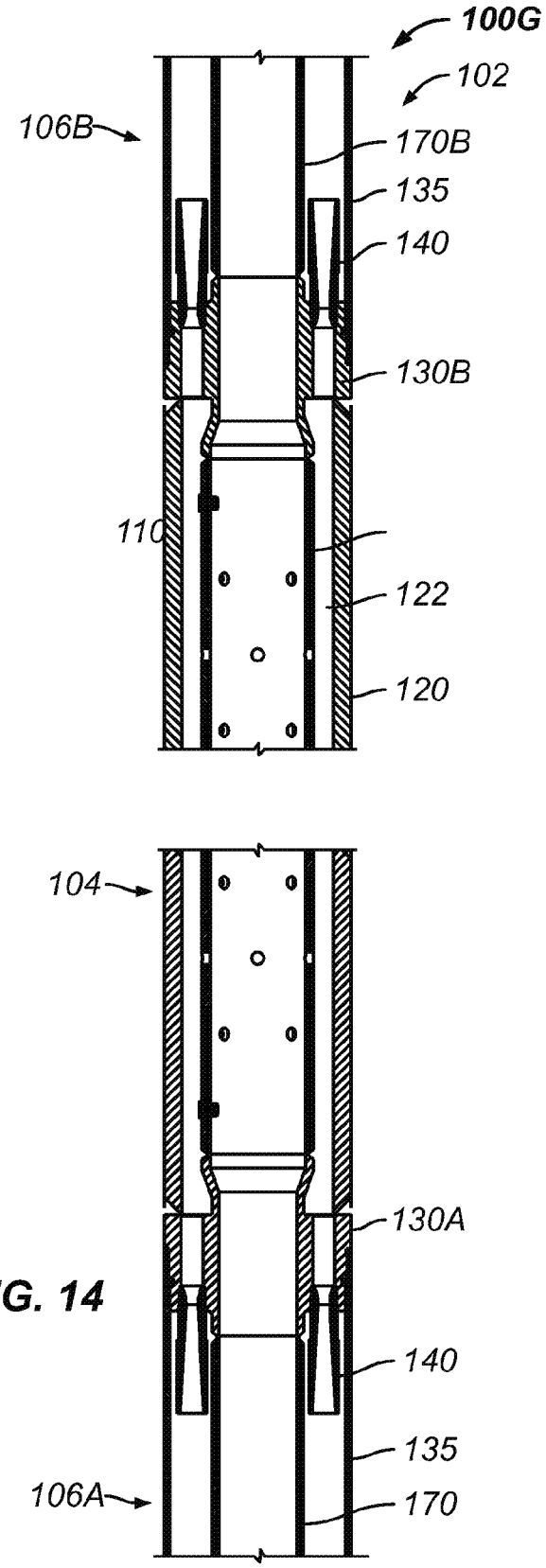
FIG. 14 shows a seventh configuration of the dual-purpose tool in cross-section having injections nozzles on opposing ends of the tool.
Figure 15A:
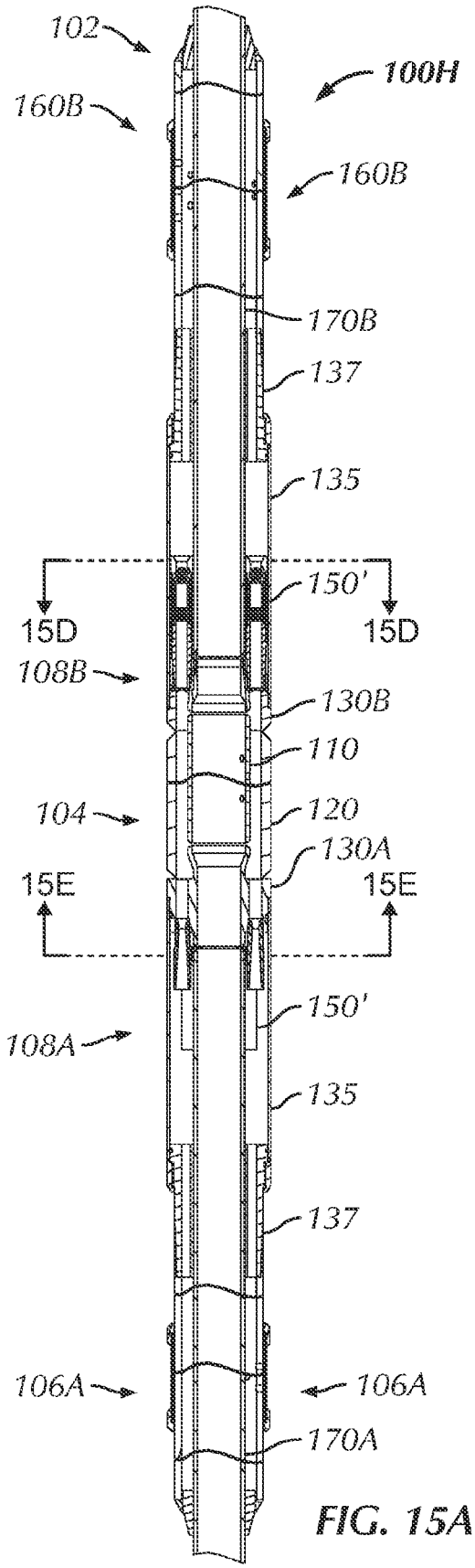
FIGS. 15A-15D show an eighth configuration of the dual-purpose tool in cross-sectional, perspective, and first and second end-sectional views.
Figure 15B:
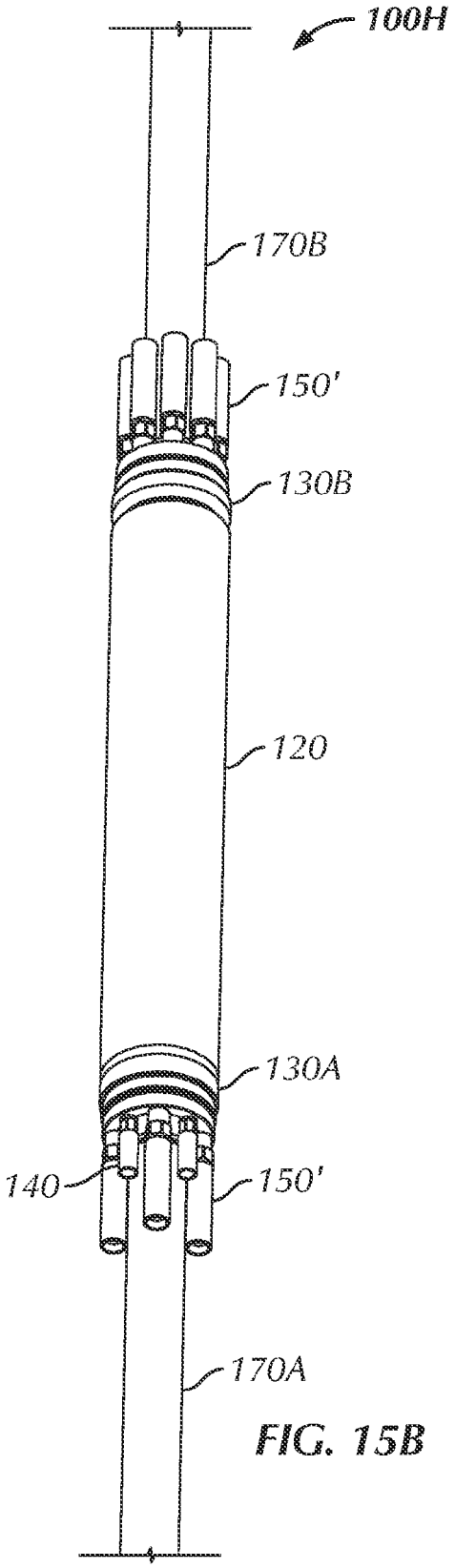
Figure 15C:
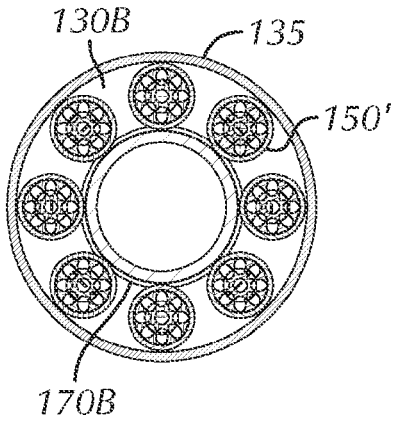
Figure 15D:
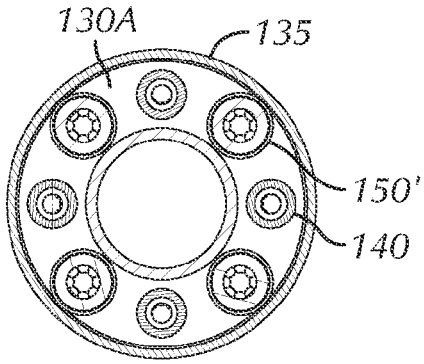

FIG. 14 shows yet another configuration of a dual purpose tool 100G, which is similar in many respects to previous tools so that like reference numerals indicate similar components. Again, the mandrel 102 has distributor and outer manifold combinations 106A-108A/106B-108B on the ends of the inner manifold 104. Here, the distributor caps 130A-B on the ends of the inner manifold 104 both have nozzles 140 for communicating steam and production fluid. Although only the intermediate sleeves 135 are shown, both outer manifold sections 106A-B have screen members (not shown) for the sets of nozzles 140. As before, production valves (150) and/or backflow valves (180) can also be used on one or both of the distributor caps 130A-B.

FIGS. 15A-15D show yet another configuration of a dual purpose tool 100H, which is similar in many respects to previous tools so that like reference numerals indicate similar components. Here, the distributor caps 130A-B both have production valves 150' for communicating production fluid, but only one cap 130A (i.e., the "downhole" cap) has nozzles 140 for communicating steam and production fluid. Intermediate sleeves 135, connectors 137, and screen members 160A-B can be used on both caps 130A-B as shown. As an additional alternative, the production valves 150' in this configuration are dart valves similar to those described previously with respect to the backflow valves (180; FIG. 9C), albeit in a reverse orientation. Therefore, any of the various flow valves used for the production valves 150/150' and backflow valves 180 can include check valves, dart valves, ball valves, and other like valves used to permit and prevent fluid flow.

Just a few dual-ended tools have been shown in FIGS. 12-15D. For example, the dual-ended tool 100E in FIG. 12 can have nozzles 140 on one distributor cap 130A with a screen member 160A and can have production valves 150 on the other distributor cap 130B with a screen member 160B. Yet, both distributor caps 130A-B can have nozzles 140 and screen members 160A-B as in the tool 100G of FIG. 14. Likewise, one distributor cap 130A can have nozzles 140 and backflow valves 180 without a screen member (160), while the other distributor cap 130B can have production valves 150 with a screen member 160B as in the tool 100F of FIG. 13.

With the benefit of the present disclosure and these examples, it will be appreciated that these and other combinations can be provided. In general then, either of the distributor caps 130A-B for a dual-ended tool can have a combination of nozzles 140, production valves 150, and/or backflow valves 180. Moreover, either of the outer manifold sections 106A-B can have or not have screen members 160.

The foregoing description of preferred and other embodiments is not intended to limit or restrict the scope or applicability of the inventive concepts conceived of by the Applicants. Several configurations for the disclosed dual-purpose tool have been described and shown in the Figures. With the benefit of the present disclosure and its teachings, the features and components of one configuration can be combined with those of another configuration to produce additional configurations within the spirit of the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A dual-purpose steam injection and production apparatus for a wellbore usable in both a steam injection operation and a production operation, the apparatus comprising:

a mandrel deploying in the wellbore and defining a flow bore, the mandrel communicating steam out of the flow bore in the steam injection operation and communicating production fluid into the flow bore in the production operation; and a distributor disposed on the mandrel and defining first and second spaces, the first space communicating with the flow bore, the second space being modular and having a plurality of configurable ports communicating with the first space, the distributor comprising:

at least one nozzle disposable at at least one of the configurable ports, the at least one nozzle permitting fluid communication of the steam out of the first space to the second space in the steam injection operation and permitting fluid communication of the production fluid from the second space into the first space in the production operation, and at least one first flow valve disposable at at least one of the configurable ports, the at least one first flow valve preventing fluid communication of the steam out of the first space to the second space in the steam injection operation and permitting fluid communication of the production fluid from the second space into the first space in the production operation; and a screen disposed on the mandrel and defining a third space, the screen screening fluid communication of the production fluid into the third space, the third space communicating with the second space of the distributor.

2. The apparatus of claim 1, wherein the at least one nozzle controls the fluid communication of the steam out of the first space.

3. The apparatus of claim 1, wherein the distributor comprises a plurality of the nozzle and a plurality of the first flow valve.

4. The apparatus of claim 1, wherein the mandrel comprises an inner body defining the flow bore and having at least one port communicating the flow bore outside the inner body; and wherein the first space of the distributor comprises an outer body disposed on the inner body and communicating with the at least one port.

5. The apparatus of claim 1, wherein the screen comprises:

a sleeve enclosing the third space about the mandrel and having one or more orifices, the one or more orifices communicating the third space with the wellbore; and a screen element disposed on the sleeve adjacent the one or more orifices.

6. The apparatus of claim 1, wherein the distributor comprises:

a first distributor member disposed toward a first end of the mandrel and at least permitting fluid communication of the steam out of the mandrel, and a second distributor member disposed toward a second end of the mandrel and at least permitting fluid communication of the production fluid into the mandrel.

7. The apparatus of claim 6, wherein the screen comprises a first screen member disposed on the mandrel toward the first end and comprises a second screen member disposed on the mandrel toward the second end, the first and second screen members screening fluid communication of the production fluid into the first and second distributor members.

8. The apparatus of claim 6, wherein the first distributor member comprises the at least one nozzle permitting fluid communication of the steam out of the mandrel.

9. The apparatus of claim 6, wherein the second distributor member comprises the at least one first flow valve preventing fluid communication of the steam out of the mandrel and permitting fluid communication of the production fluid into the mandrel.

10. The apparatus of claim 1, further comprising a toolstring having the mandrel disposed thereon and deploying in the wellbore, the toolstring having at least one isolation element isolating portions of the wellbore annulus.

11. The apparatus of claim 1, wherein the screen is selected from the group consisting of a well screen, a sand control screen, a gravel pack screen, a wire-wrapped screen, a mesh screen, an expandable sand screen, an inflow control device, a slotted liner, a perforated pipe, and a combination thereof.

12. The apparatus of claim 1, wherein the second space of the distributor comprises an intermediate sleeve modularly positioning about the mandrel between the distributor and the screen and permitting access to the configurable ports during assembly.

13. The apparatus of claim 12, wherein the screen comprises a connector disposed on the mandrel, the connector having one end communicating with the second space of the intermediate sleeve and having another end communicating with the third space of the screen.

14. The apparatus of claim 13, wherein the third space of the screen comprises an outer sleeve disposed about the mandrel, the outer sleeve having one end connected to the connector and having another end connected to the mandrel.

15. The apparatus of claim 14, wherein the outer sleeve comprises a plurality of orifices communicating the third space with the wellbore, and wherein the screen comprises a screen element disposed on the outer sleeve and screening communication through the orifices.

16. A dual-purpose steam injection and production method for a wellbore, the method comprising:

assembling a modular apparatus by accessing a plurality of configurable ports disposed on the apparatus, configuring the configurable ports to have at least one nozzle and at least one first flow valve, enclosing a space having the configurable ports with an intermediate sleeve, and communicating the space with a screen for screening the fluid communication;

deploying the apparatus in the wellbore;

performing a steam injection operation with the apparatus by injecting steam from a flow bore of the apparatus and through the at least one nozzle on the apparatus into the wellbore and preventing injection of the steam from the flow bore through the at least one first flow valve on the apparatus into the wellbore;

performing a production operation with the apparatus by permitting production fluid from the wellbore into the flow bore of the apparatus through the at least one first flow valve and permitting the production fluid from the wellbore into the flow bore of the apparatus through the at least one nozzle; and screening, with the screen, fluid communication of the production fluid through the at least one nozzle and the at least one first flow valve into the flow bore of the apparatus in the production operation.

17. The method of claim 16, wherein injecting the steam from the at least one nozzle comprises controlling the fluid communication of the steam out of the apparatus with the at least one nozzle.

18. The method of claim 16, wherein injecting steam from the at least one nozzle on the apparatus into the wellbore in the steam injection operation comprises permitting fluid communication of the steam out of a first end of the apparatus, and wherein permitting production fluid from the wellbore into the apparatus through the first flow valve in the production operation comprises permitting fluid communication of the production fluid into a second end of the apparatus.

19. The method of claim 18, wherein screening, with the screen, the fluid communication of the production fluid into the apparatus in the production operation comprises screening fluid communication of the production fluid into the first and second ends of the apparatus with first and second screen members of the screen.

20. The method of claim 18, further comprising permitting fluid communication of the production fluid through the first end of the apparatus in the production operation.

21. The method of claim 16, further comprising deploying the apparatus on a toolstring in the wellbore, and isolating portion of an annulus between the toolstring and the wellbore.

22. The method of claim 16, wherein assembling the modular apparatus comprises gaining access to the space having the configurable ports by removing the intermediate sleeve.

* * * * *